US009677331B2

(12) United States Patent
Rupel et al.

(10) Patent No.: US 9,677,331 B2
(45) Date of Patent: Jun. 13, 2017

(54) ROLLER SHADE ASSEMBLY WITH MULTIPLE SHADE CONFIGURATIONS

(71) Applicant: Hunter Douglas, Inc., Pearl River, NY (US)

(72) Inventors: John D. Rupel, Pine River, WI (US); Toralf H. Strand, Kittery, ME (US)

(73) Assignee: Hunter Douglas, Inc., Pearl River, NY (US)

( * ) Notice: Subject to any disclaimer, the term of this patent is extended or adjusted under 35 U.S.C. 154(b) by 58 days.

(21) Appl. No.: 14/613,509

(22) Filed: Feb. 4, 2015

(65) Prior Publication Data

US 2016/0222726 A1 Aug. 4, 2016

(51) Int. Cl.

| | |
|---|---|
| ***E06B 9/24*** | (2006.01) |
| ***E06B 9/42*** | (2006.01) |
| ***E06B 9/66*** | (2006.01) |
| ***E06B 9/64*** | (2006.01) |
| *E06B 9/40* | (2006.01) |
| *E06B 9/50* | (2006.01) |

(52) U.S. Cl.

CPC ..... *E06B 9/42* (2013.01); *E06B 9/64* (2013.01); *E06B 9/66* (2013.01); *E06B 9/50* (2013.01); *E06B 2009/2458* (2013.01); *E06B 2009/405* (2013.01)

(58) Field of Classification Search

CPC ..... E06B 9/66; E06B 9/42; E06B 9/44; E06B 2009/405; E06B 2009/2405; E06B 2009/2423; E06B 2009/2441; E06B 2009/2447; E06B 2009/2452; E06B 2009/2458; B60J 7/0015

See application file for complete search history.

(56) References Cited

U.S. PATENT DOCUMENTS

| | | | | |
|---|---|---|---|---|
| 1,803,883 | A * | 5/1931 | Weaver | B60J 1/2011 160/202 |
| 2,281,022 | A | 4/1942 | Cavanaugh | |
| 3,980,122 | A | 9/1976 | Takazawa | |
| 4,273,099 | A * | 6/1981 | Morgan | F24J 2/407 126/625 |
| 4,418,739 | A | 12/1983 | Woolnough et al. | |
| 4,813,198 | A * | 3/1989 | Johnston | B60J 1/2041 160/241 |
| 5,392,549 | A | 2/1995 | Castro | |
| 5,538,065 | A | 7/1996 | Geraud | |

(Continued)

*Primary Examiner* — Katherine Mitchell
*Assistant Examiner* — Abe Massad
(74) *Attorney, Agent, or Firm* — Dority & Manning, P.A.

(57) ABSTRACT

In one aspect, a roller shade assembly for an architectural opening may generally include a first roller, a second roller and a looped shade extending around the first and second rollers. The looped shade may include at least one outer shade web forming a continuous loop around the rollers. In addition, the roller shade assembly may include an inner shade web configured to be wrapped around the first roller or the second roller such that the inner shade web is positioned within the continuous loop. The inner shade web may be coupled to the outer shade web(s) at a location along an inner perimeter of the continuous loop. Additionally, rotation of the first roller and/or the second roller in an unwinding direction may result in the inner shade web being unwound from the first roller or the second roller along the inner perimeter of the continuous loop.

13 Claims, 12 Drawing Sheets

(56) References Cited

U.S. PATENT DOCUMENTS

| | | | | |
|---|---|---|---|---|
| 7,059,377 | B2 * | 6/2006 | Nien | E06B 9/42 160/120 |
| 7,849,907 | B2 | 12/2010 | Jang | |
| 8,146,646 | B1 | 4/2012 | Toder | |
| 8,646,509 | B2 * | 2/2014 | Chu | E06B 9/24 160/123 |
| 8,959,835 | B2 * | 2/2015 | Drohan | E06B 3/6722 49/63 |
| 2005/0051283 | A1 * | 3/2005 | Chatellard | E04F 10/0644 160/265 |
| 2007/0084568 | A1 | 4/2007 | Nien | |

* cited by examiner

ROLLER SHADE ASSEMBLY WITH MULTIPLE SHADE CONFIGURATIONS

FIELD OF THE INVENTION

The present subject matter relates generally to roller shade assemblies and, more particularly, to a roller shade assembly that is capable of providing multiple shade configurations, such as a transparent shade configuration, a semi-transparent or sheer shade configuration, a light filtering shade configuration and/or a black-out shade configuration.

BACKGROUND OF THE INVENTION

Various different types of coverings exist for placement in architectural openings, such as windows, doors, archways and the like. Such coverings include blinds and shades. Many shades, for instance, comprise a fabric covering that is placed in an architectural opening and includes a mounting assembly that not only mounts the shade within the opening, but also provides a control mechanism for raising and lowering the shade as desired. For instance, the control mechanism may comprise a drawstring or an electric motor.

Some shade assemblies include rollers that are rotatably mounted, usually in a horizontal orientation, across the top of the architectural opening. A shade material, such as a roller sheet shade, is attached to the roller. Rotating the roller in one direction causes the shade to extend in order to cover the architectural opening and rotating the roller in the opposite direction causes the shade to retract so as to reveal the architectural opening.

Shade assemblies that include a rotating roller, often referred to as roller shades, are very popular with consumers. Roller shades, for instance, are easy to operate and are very compact, especially when the shade is in a fully retracted position. However, conventional roller shades are often only formed using a single type of shade material and thus, only provide a single shade configuration for covering the architectural openings within which the shade is installed. As a result, such roller shades significantly limit the ability of a consumer to customize the shade configuration of his/her roller shade based on desired aesthetics and/or desired lighting effects.

Accordingly, an improved roller shade assembly that provides for multiple different shade configurations would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a roller shade assembly for an architectural opening. The roller shade assembly may generally include a first roller, a second roller configured to be spaced apart from the first roller and a looped shade extending around the first and second rollers. The looped shade may include at least one outer shade web forming a continuous loop around the first and second rollers. In addition, the roller shade assembly may include an inner shade web configured to be wrapped around the first roller or the second roller such that the inner shade web is positioned within the continuous loop formed by the outer shade web(s). The inner shade web may be coupled to the outer shade web(s) at a location along an inner perimeter of the continuous loop. Additionally, rotation of the first roller and/or the second roller in an unwinding direction may result in the inner shade web being unwound from the first roller or the second roller along the inner perimeter of the continuous loop.

In another aspect, the present subject matter is directed to a roller shade assembly for an architectural opening. The roller shade assembly may generally include a first roller, a second roller spaced apart from the first roller and a shade configured to be moved between a raised position and a lowered position with rotation of the first and second rollers. The shade may be formed from at least one outer shade web coupled between the first and second rollers. The roller shade assembly may also include an idling roller provided in association with the outer shade web(s) such that the idling roller rotates as the outer shade web(s) is unwound from the first roller and wound around the second roller as the first and second rollers are rotated when the shade is in the lowered position. In addition, the roller shade assembly may also include an inner shade web configured to be wrapped around the idling ram. The inner shade web may be coupled to an inner surface of the outer shade web(s). Moreover, rotation of the idling roller may result in the inner shade web being unwound from the idling roller in the direction of travel of the outer shade web(s).

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
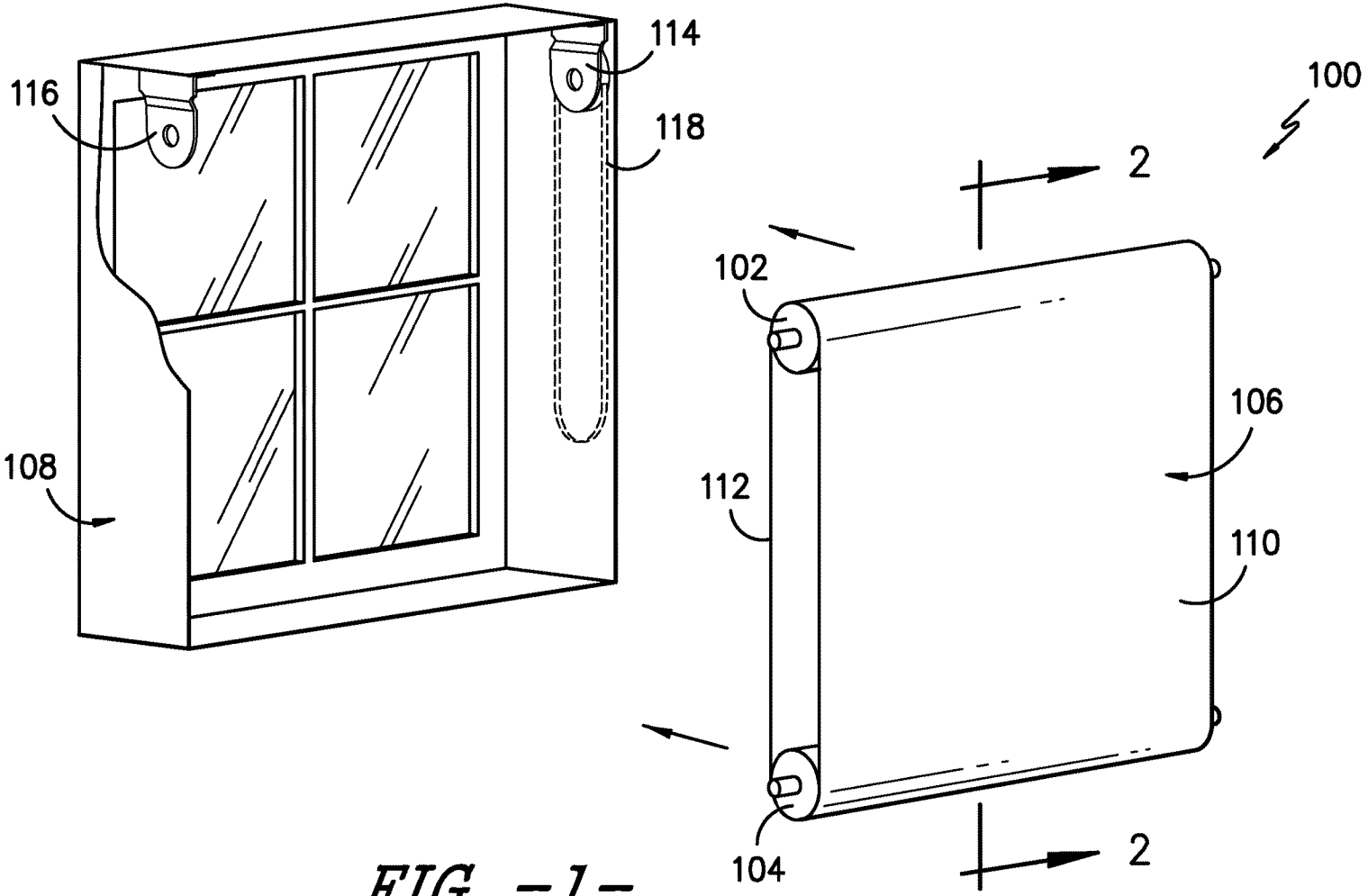
FIG. 1 illustrates a perspective view of one embodiment of a roller shade assembly in accordance with aspects of the present subject matter, particularly illustrating the roller shade assembly exploded away from an architectural opening within which the assembly is configured to be installed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a roller shade assembly that can be mounted in an architectural opening, such as a window or door, for blocking light, providing privacy, increasing the aesthetic appeal of a room and/or allowing a desired amount of light into a room. Specifically, in several embodiments, the roller shade assembly may be configured such that it provides two or more shade configurations, such as a transparent shade configuration, a semi-transparent or sheer shade configuration, a light filtering shade configuration and/or a black-out shade configuration. The various shade configurations may be achieved by associating one or more different shade webs with the rollers of the roller shade assembly, with each different shade web providing for a different shade configuration. Thus, by rotating the rollers, different shade webs may be exposed as the roller shade is moved between the rotating rollers, thereby providing the differing shade configurations.

For example, in one embodiment, the roller shade assembly may include a drive roller and an idling roller spaced apart from the drive roller in such an embodiment, a looped shade may be wrapped around the rollers so as to form a continuous loop. The looped shade may, for instance, be formed from one or more outer shade webs so as to provide a desired shade configuration for the roller shade (e.g., a transparent or sheer shade configuration). In addition, the roller shade assembly may include one or more inner shade webs wrapped around one or both of the rollers. In such an embodiment, the inner shade web(s) may be attached to the inner perimeter of the looped shade. As a result, by rotating the rollers, the inner shade web(s) may be unwound from the roller(s) along the interior of the continuous loop, thereby providing a different shade configuration(s) for the roller shade (e.g., a light filtering and/or black-out shade configuration).

In another embodiment, the roller shade assembly may include first and second drive rollers and a separate idling roller configured to be spaced apart from the drive rollers. In such an embodiment, one or more outer shade webs may be coupled to and extend between the first and second drive rollers such that, when the roller shade is in a lowered position, a desired shade configuration may be provided for the roller shade (e.g., a transparent or sheer shade configuration). In addition, the roller shade assembly may also include one or more inner shade webs wrapped around the idling roller. In such an embodiment, the inner shade web(s) may be attached at an interior location to one of the outer shade web(s) extending between the first and second drive rollers. Thus, as the idling roller is rotated with rotation of the drive rollers, the inner shade web(s) may be unwound from the idling roller along the interior of the outer shade web(s), thereby providing a different shade configuration(s) for the roller shade (e.g., a light filtering and/or black-out shade configuration).

It should be appreciated that, as used herein, the term "web" generally refers to any material suitable for use within a roller shade, including, but not limited to, woven fabrics, nonwoven fabrics, knitted fabrics, films and/or laminations of any such material(s). In several embodiments, the webs may be flexible. A flexible web is formed from a material that is capable of being folded or flexed, such as woven, knitted or nonwoven fabrics, vinyl or film sheets, cords of natural or synthetic fibers, monofilaments, and the like.

Referring now to the drawings, FIG. 1 illustrates a perspective view of one embodiment of a roller shade assembly 100 in accordance with aspects of the present subject matter. As shown, the roller shade assembly 100 may generally include a first roller 102 and a second roller 104. In general, the first roller 102 will be described herein as the master or drive roller and the second roller 104 will be described herein as the slave or idling roller. However, in other embodiments, the first roller 102 may correspond to the idling roller while the second roller 104 may correspond to the drive roller. Alternatively, both rollers 102, 104 may correspond to drive or idling rollers.

In the illustrated embodiment, the roller shade assembly 100 is shown in its lowered or extended position. In such position, as shown in FIG. 1, the idling roller 104 may generally be configured to be spaced apart from the drive roller 102 (e.g., by being lowered away from the drive roller 102) such that a shade 106 extending between the rollers 102, 104 serves to at least partially cover a window or other architectural opening 108 within which the shade assembly 100 is configured to be installed. In addition, the roller shade assembly 100 may also be movable to a raised or retracted position. For example, the idling roller 104 may be configured to be raised upwards to a location at or adjacent to the drive roller 102 so as to at least partially expose the architectural opening 108.

As will be described in greater detail below, in several embodiments, the shade 106 extending between the rollers 102, 104 may correspond to an outer shade of the shade assembly 100 that is configured to form a continuous loop around the rollers 102, 104. In such embodiments, the outer shade 106 may be configured to be formed from one or more outer shade webs (not shown in FIG. 1), including one or more shade webs formed from different shade materials. For instance, in one embodiment, the entire outer shade 106 may be formed from a looped shade web(s) that is made from a transparent or sheer material, thereby providing a transparent shade configuration or a sheer shade configuration, respectively, for the roller shade assembly 100. In another embodiment, the outer shade 106 may be formed from two or more separate shade webs made of differing shade materials, such as by coupling a sheer shade web end-to-end with a transparent shade web to form the continuous loop. In such an embodiment, when the roller shade assembly 100 is in the lowered position, the outer shade 106 may, for example, include a first face 110 formed from a sheer shade material (e.g., the face directed towards the interior of the room) and a second face 112 formed from a transparent material (e.g., the face directed away from the interior of the room). Such a combination of transparent and sheer shade materials may be desirable to avoid any moire effects associated with having two separate layers of sheer material forming the looped, outer shade 106.

Additionally, the roller shade assembly 100 may also include one or more secondary or inner shade webs (not shown in FIG. 1) wrapped around one or both of the rollers 102, 104 within the interior of the continuous loop formed by the outer shade 106. As will be described below, the inner shade web(s) may be configured to be coupled to the outer shade 106 at a location along the inner perimeter of the continuous loop. As a result, when the rollers 102, 104 are rotated after being moved to the lowered position, the inner shade web(s) may be unwound along the interior of the first or second face 110, 112 of the outer shade 106 as the outer shade web(s) forming the continuous loop is moved in a looped path around the rollers 102, 104. Such unwinding of the inner shade web(s) along the interior of the continuous loop may allow for a differing shade configuration to be provided to the roller shade assembly 100. For instance, by forming the inner shade web(s) from a light filtering or a black-out material, the shade assembly 100 may be provided with a light filtering shade configuration or a black-out shade configuration, respectively.

As indicated above, it should be appreciated that roller shade assembly 100 may generally be configured to be mounted within a window or other architectural opening 108 as may be desired. As a result, the roller shade assembly 100 may include or may be configured to be placed in operative association with any suitable hardware that allows the assembly 100 to be mounted within the architectural opening 108. For instance, as shown in FIG. 1, first and second mounting assemblies 114, 116 may be configured to be installed at a location adjacent to the architectural opening 108 for receiving the opposed ends of the drive roller 102. In such an embodiment, each mounting assembly 114, 116 may include any suitable component(s) for rotatably supporting the drive roller 102 adjacent to the architectural opening 108, such as drive components for rotationally driving the drive roller 102, locking components for locking the roller shade assembly 100 at a given position (e.g., at its raised or lowered position) and/or any other suitable components. For example, as shown in FIG. 1, a pull cord 118 may be associated with one or both of the mounting assemblies 114, 116 for allowing a user to rotationally drive the drive roller 102.

Although not shown, it should be appreciated that that the mounting assemblies 114, 116 may also include or be associated with any other suitable components for raising and/or lowering the roller shade assembly 100 between its raised and lowered positions. In such an embodiment, a separate lift cord (not shown) may, for example, be provided to allow the user to raise and lower the roller shade assembly 100 as desired.

Figure 2:
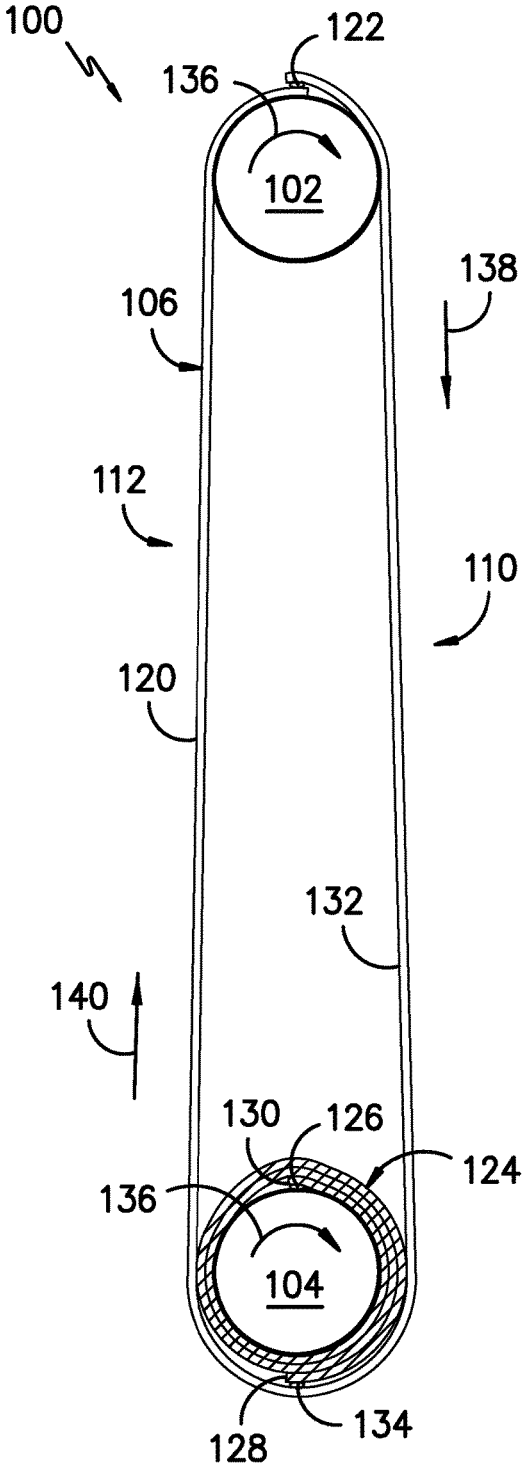
FIG. 2 illustrates a cross-sectional view of the roller shade assembly shown in FIG. 1 taken about line 2-2 of FIG. 1.

Referring now to FIG. 2, a cross-sectional view of one embodiment of the roller shade assembly 100 shown in FIG. 1 taken about line 2-2 is illustrated in accordance with aspects of the present subject matter. As indicated above, the outer shade 106 may be configured to form a continuous loop around the rollers 102, 104. For example, as shown in the illustrated embodiment, the outer shade 106 is formed from a single outer shade web 120 configured to extend around both rollers 102, 104 to as to form the continuous loop. In such an embodiment, the continuous loop may be formed by coupling the ends of the outer shade web 120 together (e.g., by using a suitable adhesive to couple the ends together at attachment location 122 shown in FIG. 2).

As indicated above, the shade web 120 used to form the outer shade 106 may be made of any suitable material that allows for the desired shade configuration to be provided for the roller shade assembly 100. For example, in a particular embodiment of the present subject matter, the shade web 120 may be made of a transparent material (e.g., a transparent film) or a sheer material. Alternatively, the shade web 120 may be made of any other suitable material, such as a light filtering material and/or a black out material.

Figure 5:
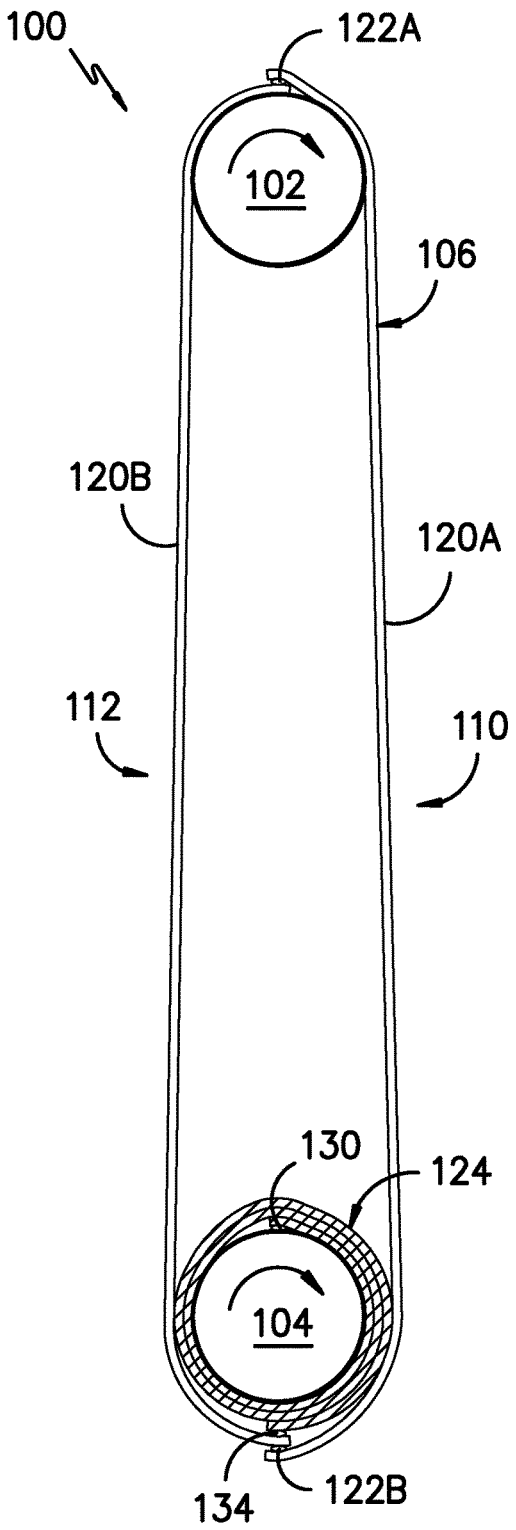
FIG. 5 illustrates a cross-sectional view of an alternative embodiment of the roller shade assembly shown in FIG. 2, particularly illustrating an outer shade of the roller shade assembly formed by two separate shade webs.

It should also be appreciated that, as indicated above, the outer shade 106 may be formed from two or more shade webs. For example, FIG. 5 illustrates another cross-sectional view of the shade assembly 100 shown in FIG. 1, particularly illustrating a variation of the embodiment shown in FIG. 2. As shown in FIG. 5, the outer shade 106 is formed from a first shade web 120A and a second shade web 120B. In such an embodiment, the first and second shade webs 120A, 120B may be coupled end-to-end (e.g., by using a suitable adhesive) so as to form the continuous loop extending around the rollers 102, 104. Specifically, as shown in FIG. 5, adjacent ends of the first and second shade webs 120A, 120B may be coupled together at both a first attachment location 122A and a second attachment location 122B, thereby forming a continuous loop around rollers 102, 104. Although the outer shade 106 is shown in FIG. 5 as being formed from two separate shade webs, one of ordinary skill in the art should readily appreciate that the outer shade 106 may also be formed from any other suitable number of shade webs coupled end-to-end so as to form the continuous loop, such as three or more shade webs.

Additionally, it should be appreciated that, in embodiments in which the outer shade 106 is formed from two or more separate shade webs, each shade web may be formed from the same or a different material. For example, in the embodiment shown in FIG. 5, the first shade web 120A may be formed from a transparent material whereas the second shade web 120B may be formed from a sheer material. As a result, when the outer shade 106 is positioned on the rollers 102, 104 as shown in FIG. 5, the first face 110 of the roller shade 106 may have a transparent shade configuration while the second face 112 of the roller shade 106 may have a sheer shade configuration. As indicated above, such differentiation of materials between the first and second faces 110, 112 of the roller shade assembly 100 may be desirable to avoid the moire effect that may occur if both faces 110, 112 were formed from a sheer material.

Referring hack to FIG. 2, as indicated above, the roller shade assembly 100 may also include one or more inner shade webs 124 configured to be wrapped around one or both of the rollers 102, 104. For instance, as shown in the illustrated embodiment, the inner shade web 124 is wrapped around the idling roller 104. However, in other embodiments, the inner shade web 124 may be wrapped around the drive roller 104. Similarly, as will be described below with reference to FIGS. 9-11, the roller shade assembly 100 may include an inner shade web wrapped around each of the rollers 102, 104.

In several embodiments, the inner shade web 124 may be configured to be coupled at one end to the inner perimeter of the continuous loop defined by the outer shade 106 and at the other end to its respective roller. For example, as shown in FIG. 2, the inner shade web 124 is wrapped around the idling roller 104 between an inner end 126 and an outer end 128. In such an embodiment, the inner end 126 of the inner shade web 124 may be coupled to the idling roller 104 (e.g., by using a suitable adhesive at attachment location 130 shown in FIG. 2) and the outer end 128 of the inner shade web 124 may be coupled to the inner perimeter of the outer shade 106 (e.g., by using a suitable adhesive). For instance, as shown in FIG. 2, the outer end 128 may be coupled to an inner surface 132 of the outer shade 106 at a suitable attachment location 134 around the inner perimeter of the continuous loop. As will be described below, by coupling the outer end 128 of the inner shade web 124 to the inner surface 132 of the outer shade 106, the inner shade web 124 may be configured to be unwound from the idling roller 104 when the outer shade 106 is moved in a looped path around the rollers 102, 104 via rotation of the rollers 102, 104 in a first direction (e.g., in a clock-wise direction). Similarly, by rotating the rollers in the opposite direction (e.g., in a counter clock-wise direction), the inner shade web 124 may be re-wound around the idling roller 104.

Figure 3:
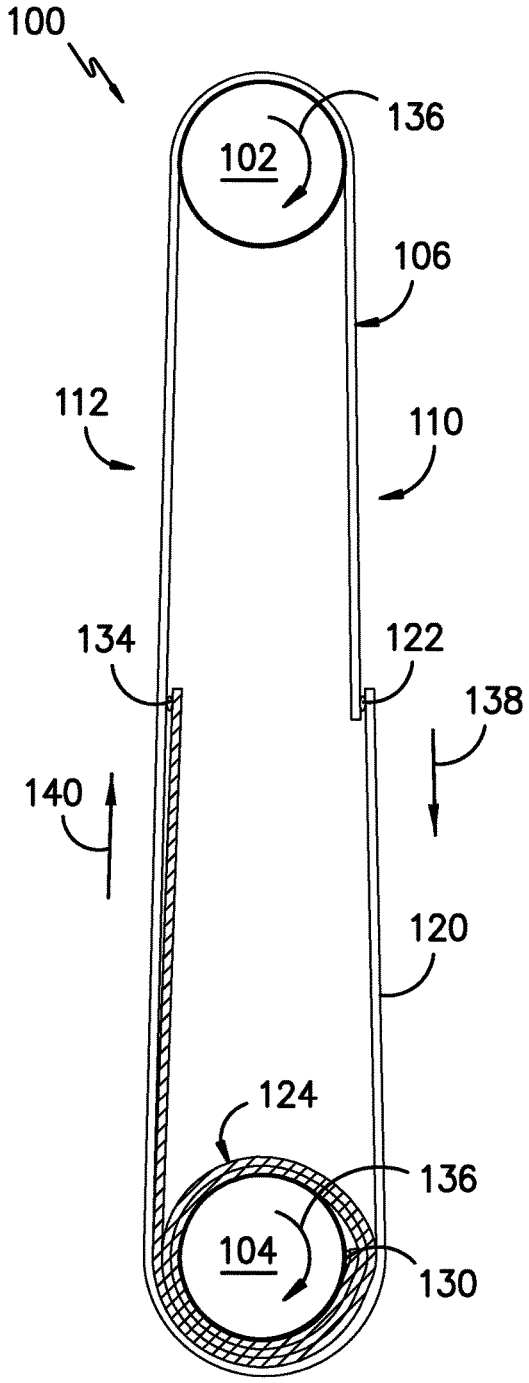
FIG. 3 illustrates another cross-sectional view of the roller shade assembly shown in FIG. 2, particularly illustrating the roller shade assembly after a portion of an inner shade web of the assembly has been unwound from one of the rollers.
Figure 4:
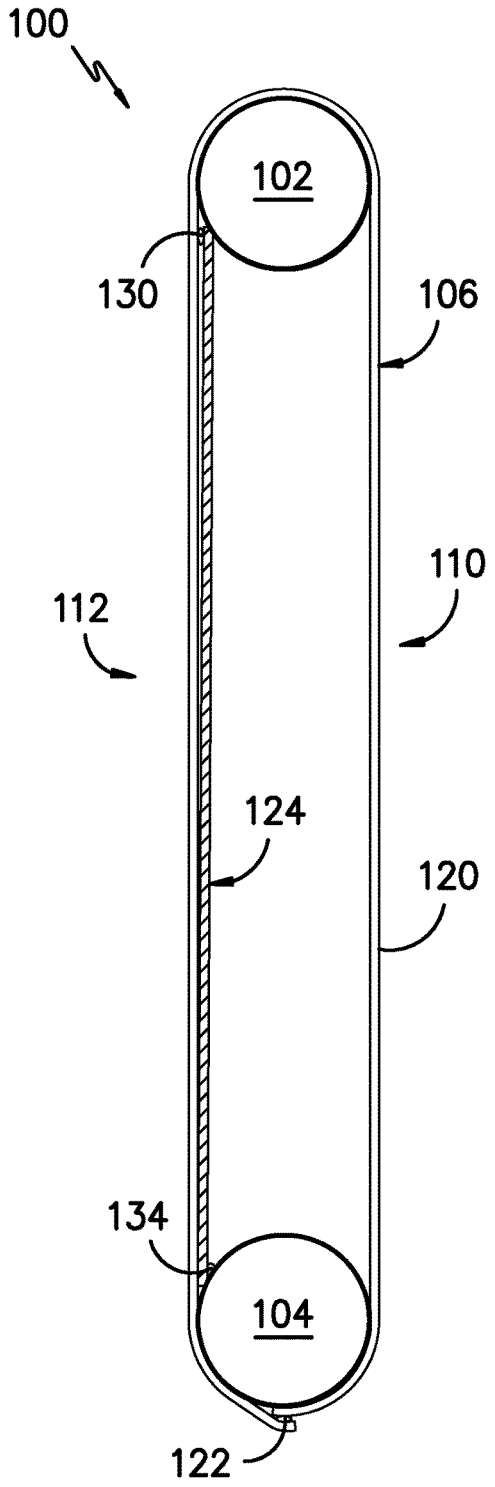
FIG. 4 illustrates yet another cross-sectional view of the roller shade assembly shown in FIGS. 2 and 3, particularly illustrating the inner shade web being unwound from the roller.

Referring now to FIGS. 2-4, a time-ordered progression of the roller shade assembly 100 described above is illustrated as the rollers 102, 104 are rotated in a given direction (e.g., in the clock-wise direction) so as to adjust the shade configuration of the assembly 100. As shown in FIG. 2, when the roller shade assembly 100 is in its lowered position, an initial rotation of the first and second rollers 102, 104 in the clockwise direction (e.g., as indicated by arrows 136 in FIG. 2) results in the continuous loop formed by the outer shade 106 to be moved in a looped path in such direction. Specifically, as shown in FIG. 2, rotation of the rollers 102, 104 in the clockwise direction results in the portion of the shade web(s) 120 located along the first face 110 of the outer shade 106 to be moved downwardly (as indicated by arrow 128 in FIG. 2) towards the idling roller 104 and the portion of the shade web(s) 120 located along the second face 112 of the outer shade 106 to be moved upwardly (as indicated by arrow 140 in FIG. 2) towards the drive roller 102.

Additionally, as shown in FIGS. 3 and 4, as the rollers 102, 104 continue to be rotated in the clockwise direction (as indicated by arrows 136 in FIG. 3), the inner shade web 124 may be unwound from the idling roller 104 such that the inner shade web 124 travels with the outer shade web 106 along the looped path. Specifically, in the illustrated embodiment, the clockwise rotation of the rollers 102, 104 results in the inner shade web 124 moving upwardly (as indicated by arrow 140 in FIG. 3) with the outer shade web 106 along the second face 112 of the outer shade 106. As a result, by controlling the amount of the inner shade web 124 that is unwound from the idling roller 104, the shade configuration for the roller shade assembly 100 may be adjusted. For instance, as shown in FIG. 3, the inner shade web 123 has been unwound from the idling roller 104 such that the shade web 124 extends only partially between the rollers 102, 104, which may, for example, be used to create a non-uniform shade configuration in which the amount of light passing through the roller shade assembly 100 differs vertically along the height of the assembly 100.

Similarly, as shown in FIG. 4, the inner shade web 124 has been unwound from the idling roller 104 such that the shade web 124 extends fully between the rollers 102, 104, which may allow for a uniform shade configuration to be provided along the height of the roller shade assembly 100. For example, by forming the inner shade web 123 from a light filtering material, the shade configuration for the roller assembly 100 may adjusted from the previous shade configuration provided by the outer shade web(s) 120 (e.g., a transparent or sheer shade configuration) to a light filtering shade configuration. Similarly, by forming the inner shade web 124 from a black-out material, the shade configuration for the roller assembly 100 may be adjusted from the previous shade configuration to a black-out shade configuration.

It should be appreciated by those of ordinary skill in the art that, by rotating the rollers 102, 104 in the opposite direction, the inner shade web 124 may be re-wound around the idling roller 104, thereby returning the roller shade assembly 100 to its original shade configuration. For example, in the embodiment shown in FIGS. 2-4, rotation of the rollers 102, 104 in the counter clock-wise direction may result in the inner shade web 124 being re-wound around the idling roller 104.

Figure 6:
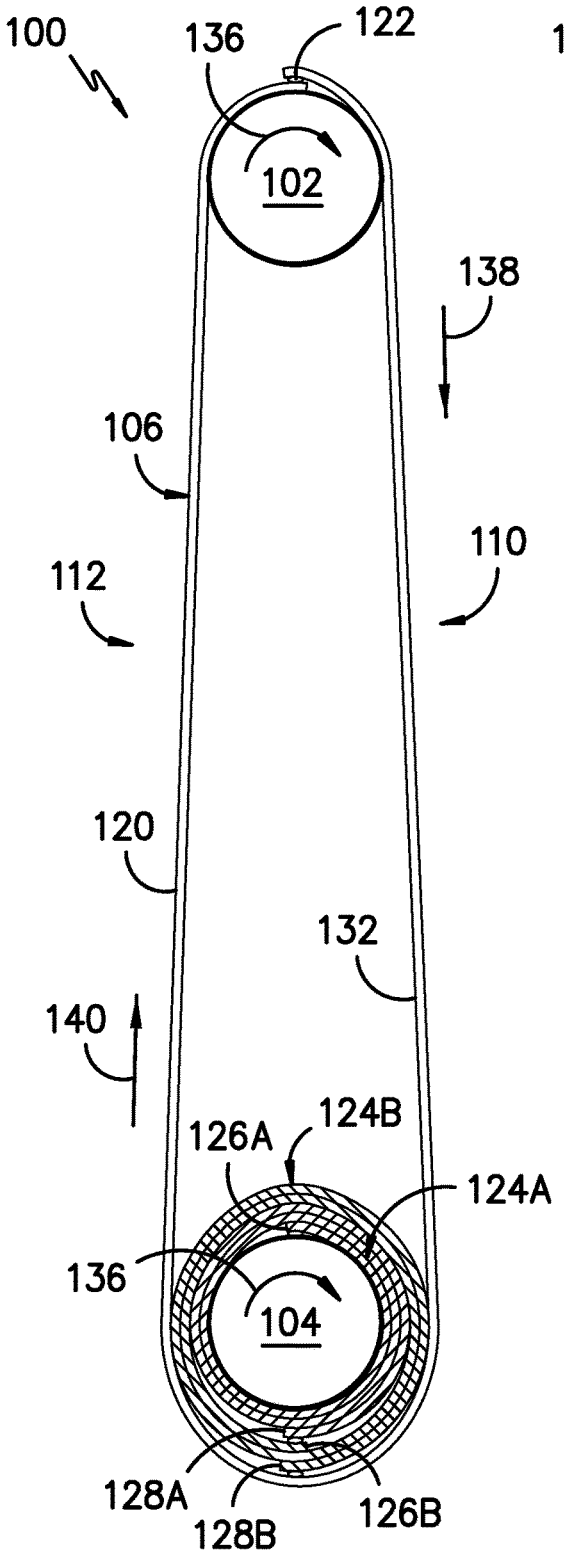
FIG. 6 illustrates a cross-sectional view of another embodiment of the roller shade assembly shown in FIG. 2, particularly illustrating the roller shade assembly including two separate inner shade webs wrapped around one of the rollers.

Referring now to FIG. 6, a cross-sectional view of another variation of the roller shade assembly 100 shown in FIG. 2 is illustrated in accordance with aspects of the present subject matter. As shown, instead of including a single inner shade web 124 wrapped around the idling roller 104, the roller shade assembly 100 includes both a first inner shade web 124A and a second inner shade web 124B wrapped around the idling roller 104. In such an embodiment, the first and second inner shade webs 124A, 124B may be configured to be coupled together end-to-end between the idling roller 104 and the inner perimeter of the outer shade 106. For example, as shown in FIG. 6, the first inner shade web 124A includes an inner end 126A coupled to the idling roller 104 (e.g., via a suitable adhesive) and an outer end 128A coupled to a corresponding inner end 126B of the second inner shade web 124B (e.g., via a suitable adhesive). Additionally, the second inner shade web 124B extends from its inner end 126B to an outer end 128B coupled to the inner surface 132 of the outer shade web(s) 120 at a location along the inner perimeter of the continuous loop formed by the outer shade 106. As such, as the rollers 102, 104 are rotated in a given direction, the second inner shade web 124B may be initially unwound from the idling roller 104. Thereafter, when the inner end 126B of the second inner shade web 124B is reached, further rotation of the rollers 102, 104 may result in the first inner shade web 124A being unwound from the idling roller 104.

Figure 7:
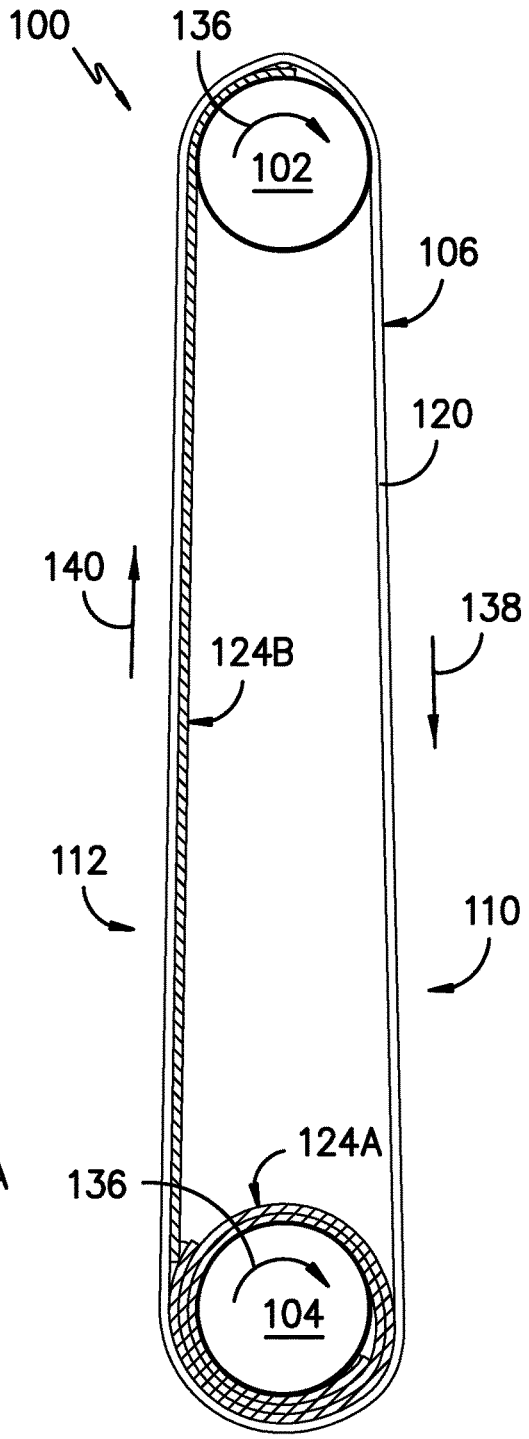
FIG. 7 illustrates another cross-sectional view of the roller shade assembly shown in FIG. 6, particularly illustrating the roller shade assembly after one of the inner shade webs has been unwound from the roller.
Figure 8:
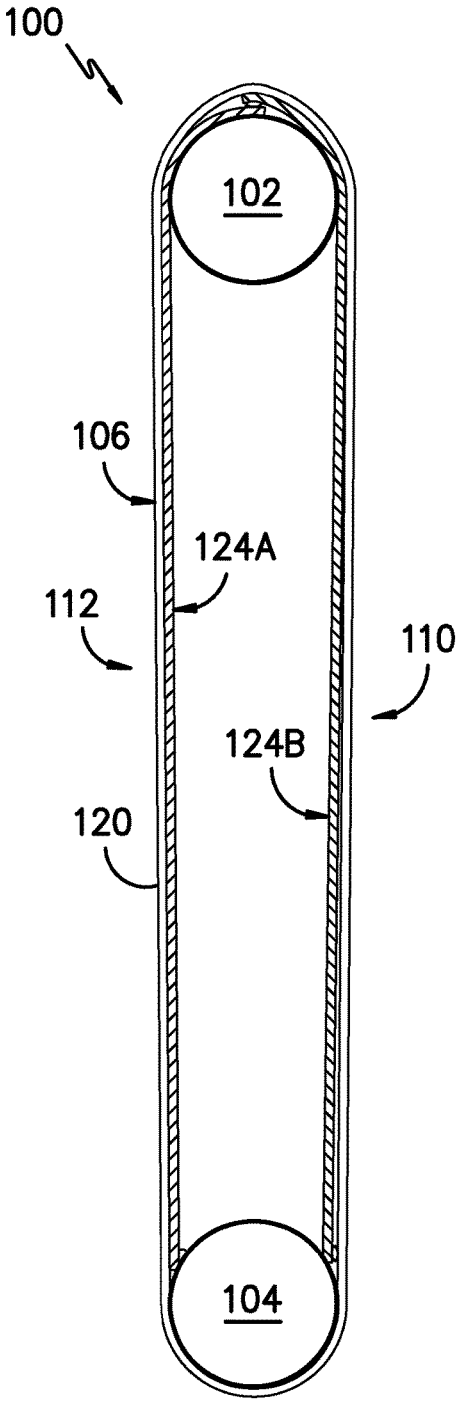
FIG. 8 illustrates yet another cross-sectional view of the roller shade assembly shown in FIG. 6, particularly illustrating the roller shade assembly after bath of the inner shade webs have been unwound from the roller.

For example, FIGS. 6-8 illustrate a time-ordered progression of the roller shade assembly 100 described above with reference to FIG. 6 as the rollers 104, 104 are rotated so as to adjust the shade configuration of the assembly 100. As shown in FIG. 6, when the roller shade assembly 100 is in its lowered position, an initial rotation of the rollers 102, 104 in the clockwise direction (e.g., as indicated by arrow 136 in FIG. 6) results in the continuous loop formed by the outer shade 106 to be moved in a looped path in such direction. Specifically, as shown in FIG. 6, rotation of the rollers 102, 104 in the clockwise direction results in the portion of the shade web(s) 120 located along the first face 110 of the outer shade 106 to be moved downwardly (as indicated by arrow 138 in FIG. 6) towards the idling roller 104 and the portion of the shade web(s) 120 located along the second face 112 of the outer shade 106 to be moved upwardly (as indicated by arrow 140 in FIG. 6) towards the drive roller 102.

Additionally, as shown in FIGS. 7 and 8, as the rollers 102, 104 continue to be rotated in the clockwise direction (as indicated by arrows 136 in FIG. 7), the inner shade webs 124B may be unwound from the idling roller 104 such that the shade webs 124A, 124B travel with the outer shade web 120 along the looped path. Specifically, as shown in FIG. 7, the second inner shade web 124B has been unwound from the idling roller 102 such that it extends fully between the rollers 102, 104. As a result, the shade configuration for the roller shade assembly 100 may be adjusted from its original configuration to a new configuration depending on the material selected for the second inner shade web 124B. For example, if the second inner shade web 124B is formed from a light-filtering material, the shade configuration may be adjusted from the original shade configuration (e.g., a transparent or sheer shade configuration) to a light filtering shade configuration.

Moreover, as shown in FIG. 8, the rollers 102, 104 have been further rotated such that both the first and second inner shade webs 124A, 124B have been unwound from the idling roller 104. Specifically, in the illustrated embodiment, the first inner shade web 124A extends along the inner perimeter of the second face 112 of the outer shade 106 and the second inner shade web 124B extends along the inner perimeter of the first face 110 of the outer shade 106. As a result, yet another shade configuration may be provided to the roller shade assembly 100. For example, if the first inner shade web 124A is formed from a black-out material, the shade configuration for the roller assembly 100 may be adjusted from the shade configuration provided via the second inner shade web 124A (e.g., a light filtering shade configuration) to a black-out shade configuration.

Figure 9:
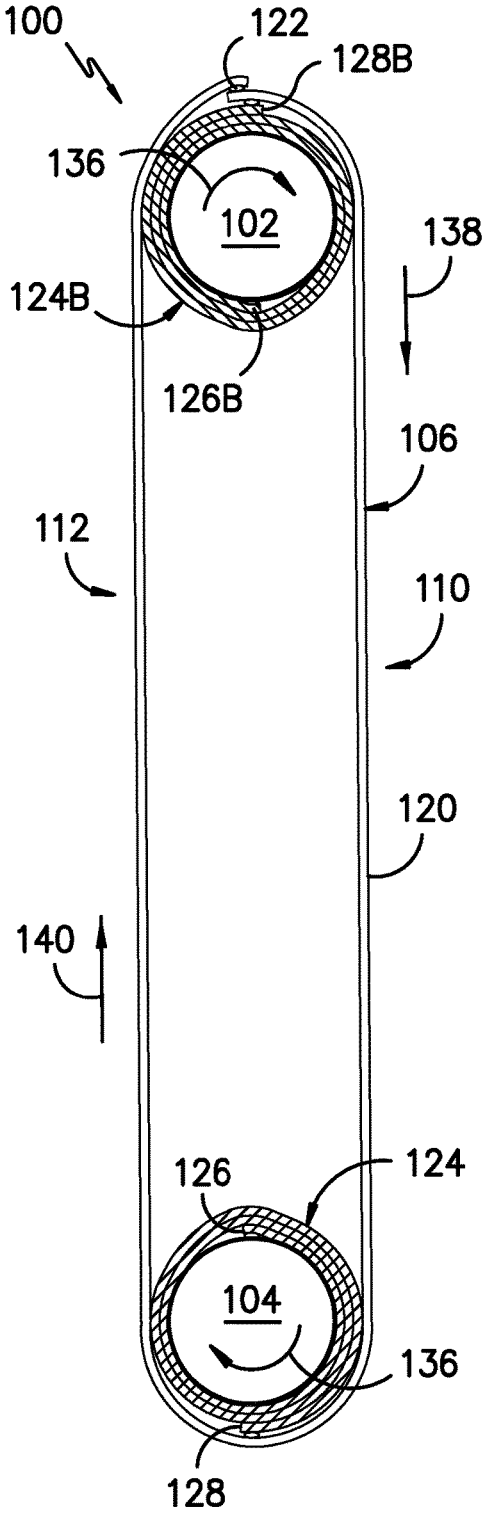
FIG. 9 illustrates a cross-sectional view of another embodiment of the roller shade assembly shown in FIG. 2, particularly illustrating the roller shade assembly including inner shade webs wrapped around both of the rollers.

Referring now to FIG. 9, a cross-sectional view of yet another variation of the roller shade assembly 100 shown in FIG. 2 is illustrated in accordance with aspects of the present subject matter. As shown, instead of only including an inner shade web 124 wrapped around the idling roller 104, the roller shade assembly 100 includes a second inner shade web 124B wrapped around the drive roller 102. In such an embodiment, the second inner shade web 124B may be configured the same as or similar to the inner shade web 124 wrapped around the idling roller 104. For example, as shown in FIG. 9, the second inner shade web 124B may extend between an inner end 126B and an outer end 128B, the with the inner end 126B being coupled to the drive roller 102 and the outer end 128B being coupled to the outer shade 106 at a location along the inner perimeter of the continuous loop. As a result, when the rollers 102, 104 are rotated in a given direction, each inner shade web 124, 124B may be unwound from its respective roller 102, 104 so as to allow for the shade configuration of the roller shade assembly 100 to be adjusted.

Figure 10:
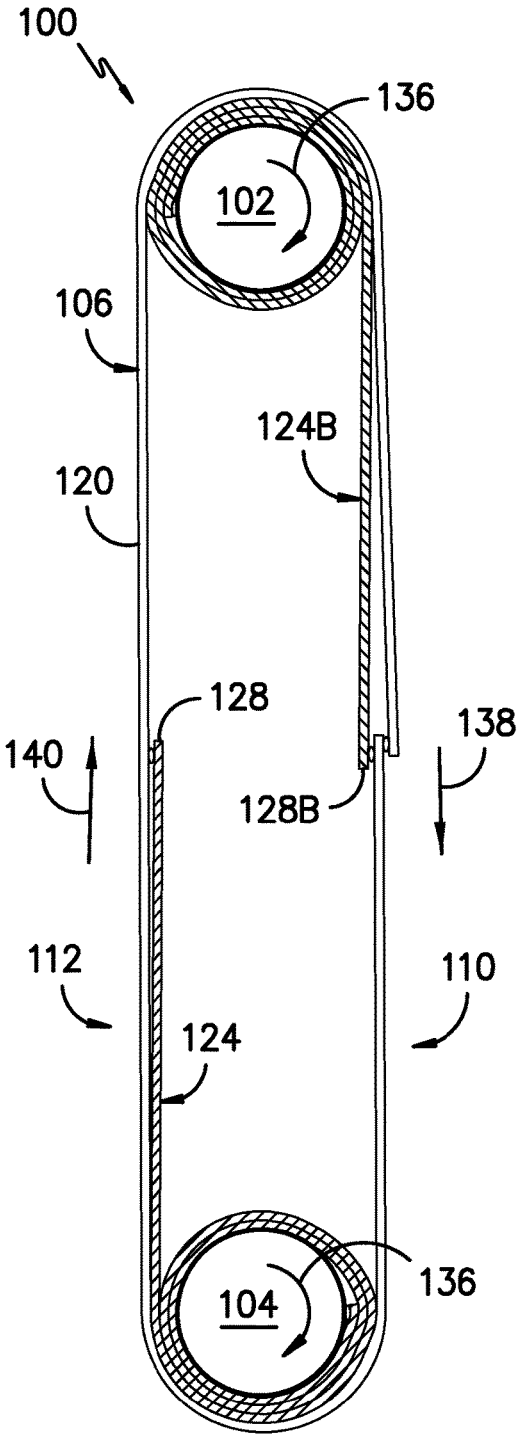
FIG. 10 illustrates another cross-sectional view of the roller shade assembly shown in FIG. 9, particularly illustrating the roller shade assembly after the inner shade webs have been partially unwound from their respective rollers.
Figure 11:
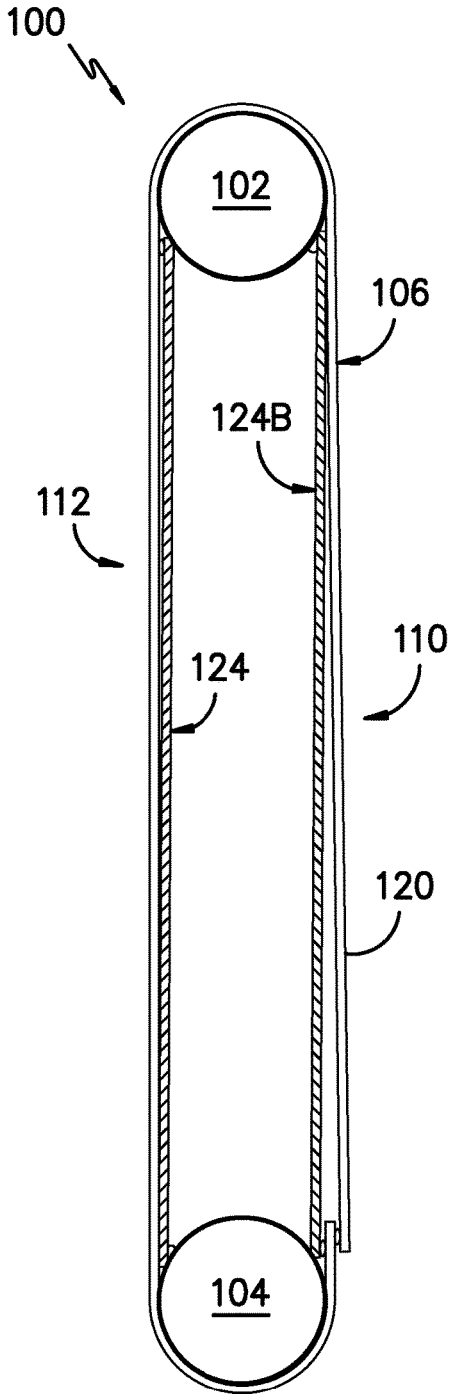
FIG. 11 illustrates yet another cross-sectional view of the roller shade assembly shown in FIG. 9, particularly illustrating the roller shade assembly after both inner shade webs have been fully unwound from their respective rollers.

For example, FIGS. 9-11 illustrate a time-ordered progression of the roller shade assembly 100 described above with reference to FIG. 9 as the rollers 102, 104 are rotated so as to adjust the shade configuration of the assembly 100. As shown in FIG. 9, when the roller shade assembly 100 is in its lowered position, an initial rotation of the rollers 102, 104 in the clockwise direction (e.g., as indicated by arrows 136 in FIG. 9) results in the continuous loop formed by the outer shade 106 to be moved in a looped path in such direction. Specifically, as shown in FIG. 9, rotation of the rollers 102, 104 in the clockwise direction results in the portion of the shade web(s) 120 located along the first face 110 of the outer shade 106 to be moved downwardly (as indicated by arrow 138 in FIG. 6) towards the idling roller 104 and the portion of the shade web(s) 120 located along the second face 112 of the outer shade 106 to be moved upwardly (as indicated by arrow 140 in FIG. 6) towards the drive roller 102.

Additionally, as shown in FIGS. 10 and 11, as the rollers continue to be rotated in the clockwise direction (as indicated by arrows 136 in FIG. 10), each inner shade web 124, 124B may be unwound from its respective roller 102, 104 such that the shade webs 124, 124B travel with the outer shade web 120 along the looped path. Specifically, as shown in FIG. 10, the inner shade webs 124, 124B have been unwound from the each roller 102, 104 such that the outer ends 128, 128B of the webs 124, 124B are aligned at a location between the rollers 102, 104 halfway between the rollers 102, 104). Similarly, as shown in FIG. 11, the rollers 102, 104 have been further rotated such that both inner shade webs 124, 124B have been fully unwound from their respective rollers 102, 104 and overlap one another along the height of the roller shade assembly 100. Similar to the other embodiments described above, the roller shade assembly 100 shown in FIGS. 9-11 may allow for multiple shade configurations to be provided. For example, a first shade configuration may be provided by the outer shade web(s) 120 (as shown in FIG. 9), a second shade configuration may be provided when the ends of the inner shade webs 124, 124B are aligned (e.g., as shown in FIG. 10) and a third shade configuration may be provided when the inner shade webs 124, 124B overlap one another along the height of the roller shade assembly 100 (as shown in FIG. 11).

Figure 12:
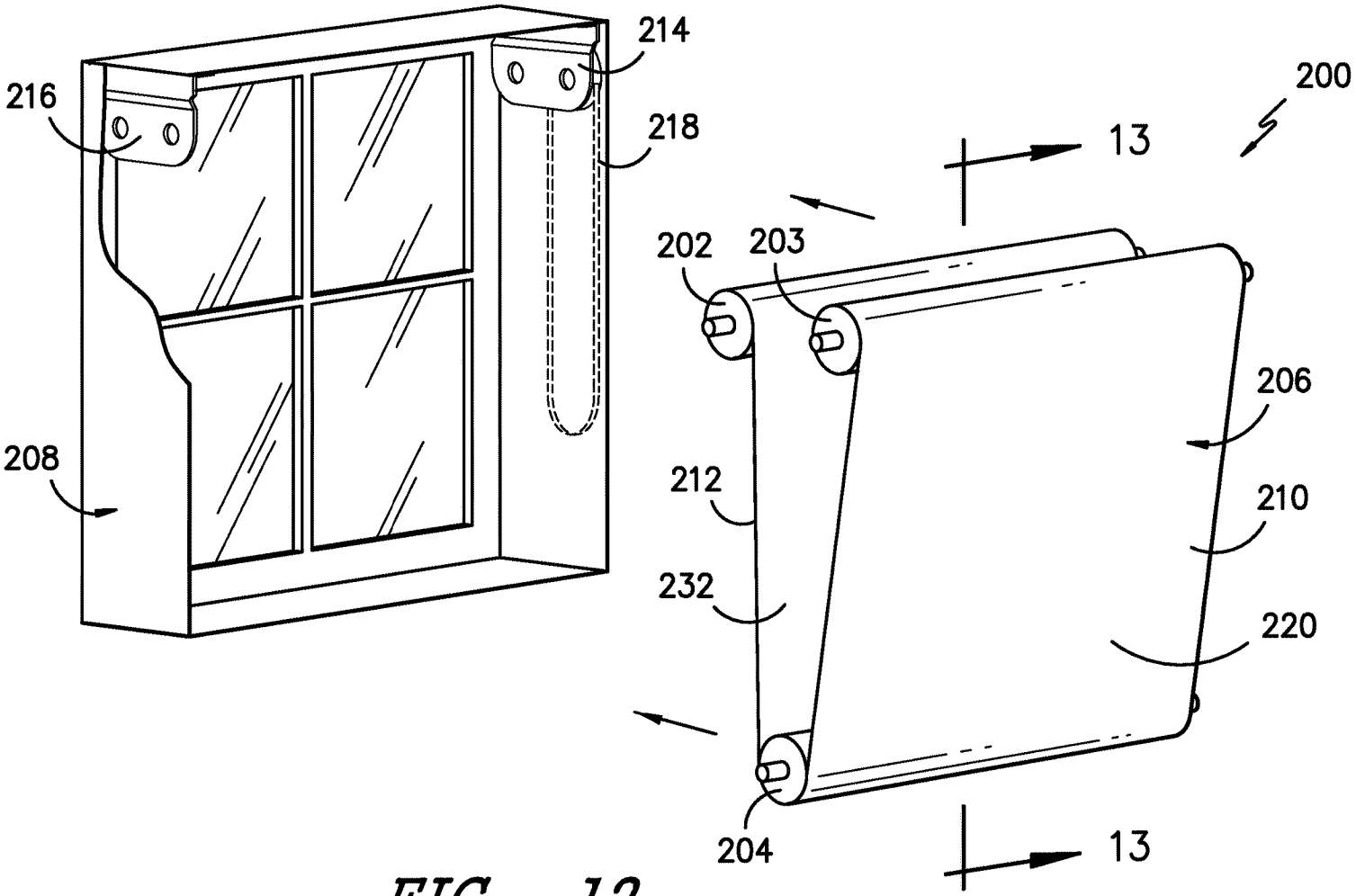
FIG. 12 illustrates a perspective view of a further embodiment of a roller shade assembly in accordance with aspects of the present subject matter, particularly illustrating the roller shade assembly exploded away from an architectural opening within which the assembly is configured to be installed.

Referring now to FIG. 12, a perspective view of another embodiment a roller shade assembly 200 is illustrated in accordance with aspects of the present subject matter. As shown, the roller shade assembly 200 may generally include a first roller 202, a second roller 203 and a third roller 204. In general, the first and second rollers 202, 203 will be described herein as the master or drive rollers and the third roller 204 will be described herein as the slave or idling roller.

In the illustrated embodiment, the roller shade assembly 200 is shown in its lowered or extended position. In such position, as shown in FIG. 12, the idling roller 204 may generally be configured to be spaced apart from the first and second drive rollers 202, 203 (e.g., by being lowered away from the drive rollers 202, 203) such that an outer shade 206 extending therebetween serves to at least partially cover a window or other architectural opening 208 within which the shade assembly 200 is configured to be installed. In addition, the roller shade assembly 200 may also be movable to a raised or retracted position. For example, the idling roller 204 may be configured to be raised upwards to a location at or adjacent to the first and second drive rollers 202, 203 so as to at least partially expose the architectural opening 208.

It should be appreciated that the outer shade 206 may be configured to be formed from one or more shade webs 220, including one or more shade webs formed from different shade materials. For instance, in one embodiment, the entire outer shade 106 may be formed from a single shade web(s) 220 that is made from a transparent or sheer material, thereby providing a transparent shade configuration or a sheer shade configuration, respectively, for the roller shade assembly 200. In another embodiment, the outer shade 206 may be formed from two or more separate shade webs 220 made of differing shade materials, such as by coupling a sheer shade web end-to-end with a transparent shade web to form the outer shade 106. In such an embodiment, when the roller shade assembly 200 is in the lowered position, the outer shade 206 may for example, include a first face 210 formed from a sheer shade material and a second face 212 formed from a transparent material. Such a combination of transparent and sheer shade materials may be desirable to avoid any moire effects associated with having two separate layers of sheer material.

Additionally, in several embodiments, the roller shade assembly 200 may also include one or more secondary or inner shade webs (not shown in FIG. 2) wrapped around the idling roller 204. Specifically, as will be described below, the inner shade webs) may be configured to be coupled to the outer shade 206 at a location along an inner surface 232 of the outer shade 206. As a result, when the idling roller 204 is rotated with rotation of the first and second drive rollers 202, 203, the inner shade web(s) may be unwound along the interior of the first or second face 210, 212 of the outer shade 206 as the outer shade web 220 is moved between the drive rollers 202, 203. Such unwinding of the inner shade web(s) along the interior of the outer shade 206 may allow for a differing shade configuration to be provided to the roller shade assembly 200. For instance, by forming the inner shade web(s) from a light filtering or a black-out material, the shade assembly 200 may be provided with a light filtering shade configuration or a black-out shade configuration, respectively.

Similar to the embodiment described above with reference to FIG. 1, it should be appreciated that the roller shade assembly 200 may generally be configured to be mounted within a window or other architectural opening 208 as may be desired. As a result, the roller shade assembly 200 may include or may be configured to be placed in operative association with any suitable hardware that allows the roller shade assembly 200 to be mounted within the architectural opening 208. For instance, as shown in FIG. 12, first and second mounting assemblies 214, 216 may be mounted on opposing sides of the architectural opening 208 for receiving the opposed ends of the first and second drive rollers 202, 203. In such an embodiment, each mounting assembly 214, 216 may include any suitable component(s) torr rotatably supporting the drive rollers 202, 203 adjacent to the architectural opening 208, such as drive components for rotationally driving the drive rollers 202, 203, locking components for locking the roller shade assembly 200 at a given position (e.g., at its raised or lowered position) and/or any other suitable components. For example, as shown in FIG. 12, a pull cord 218 may be associated with one or both of the mounting assemblies 214, 216 for allowing a user to rotationally drive the drive rollers 202, 203.

It should be appreciated that, in several embodiments, it may be desirable for the first and second drive rollers 202, 203 to be rotationally coupled to one another such that both rollers rotate simultaneously when the pull cord 218 is used to drive the rollers 202, 203. In this regard, the drive rollers 202, 203 may be rotationally coupled to one another using any suitable coupling arrangement known in the art that allows for simultaneous rotation of the rollers 202, 203. For instance, in one embodiment, each roller 202, 203 may include a pulley or other similar type of feature formed thereon or coupled thereto (e.g., at the ends of the rollers 202, 203) that is configured to receive a belt. In such an embodiment, the belt may be configured to transfer rotational movement from one roller to the other, thereby allowing both rollers 202, 203 to rotate simultaneously. In another embodiment, each drive roller 202, 203 may include a gear formed thereon or coupled thereto that is configured to engage a mating gear associated with the other roller.

Figure 13:
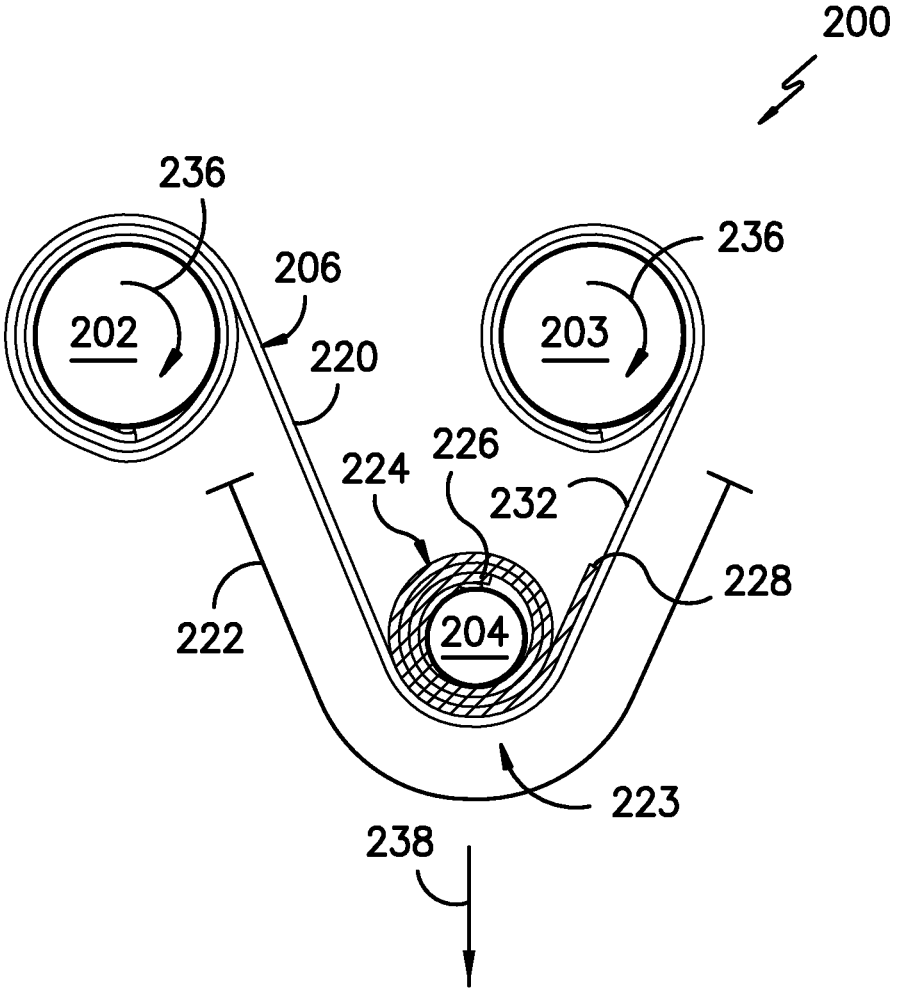
FIG. 13 illustrates a cross-sectional view of the roller shade assembly shown in FIG. 12 taken about line 13-13 of FIG. 12, particularly illustrating the roller shade assembly in its raised position.
Figure 14:
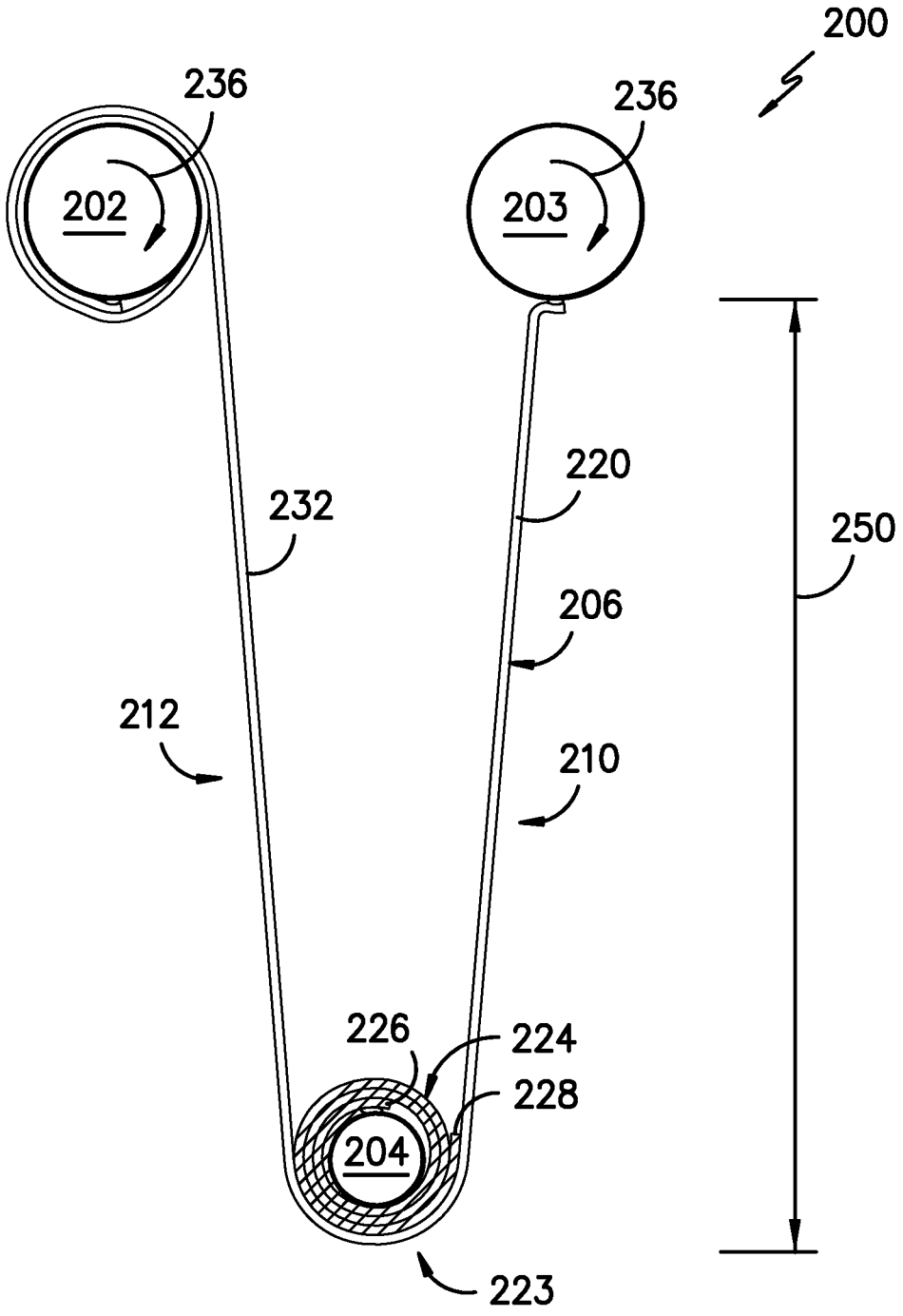
FIG. 14 illustrates another cross-sectional view of the roller shade assembly shown in FIG. 13, particularly illustrating the roller assembly in its lowered position.
Figure 15:
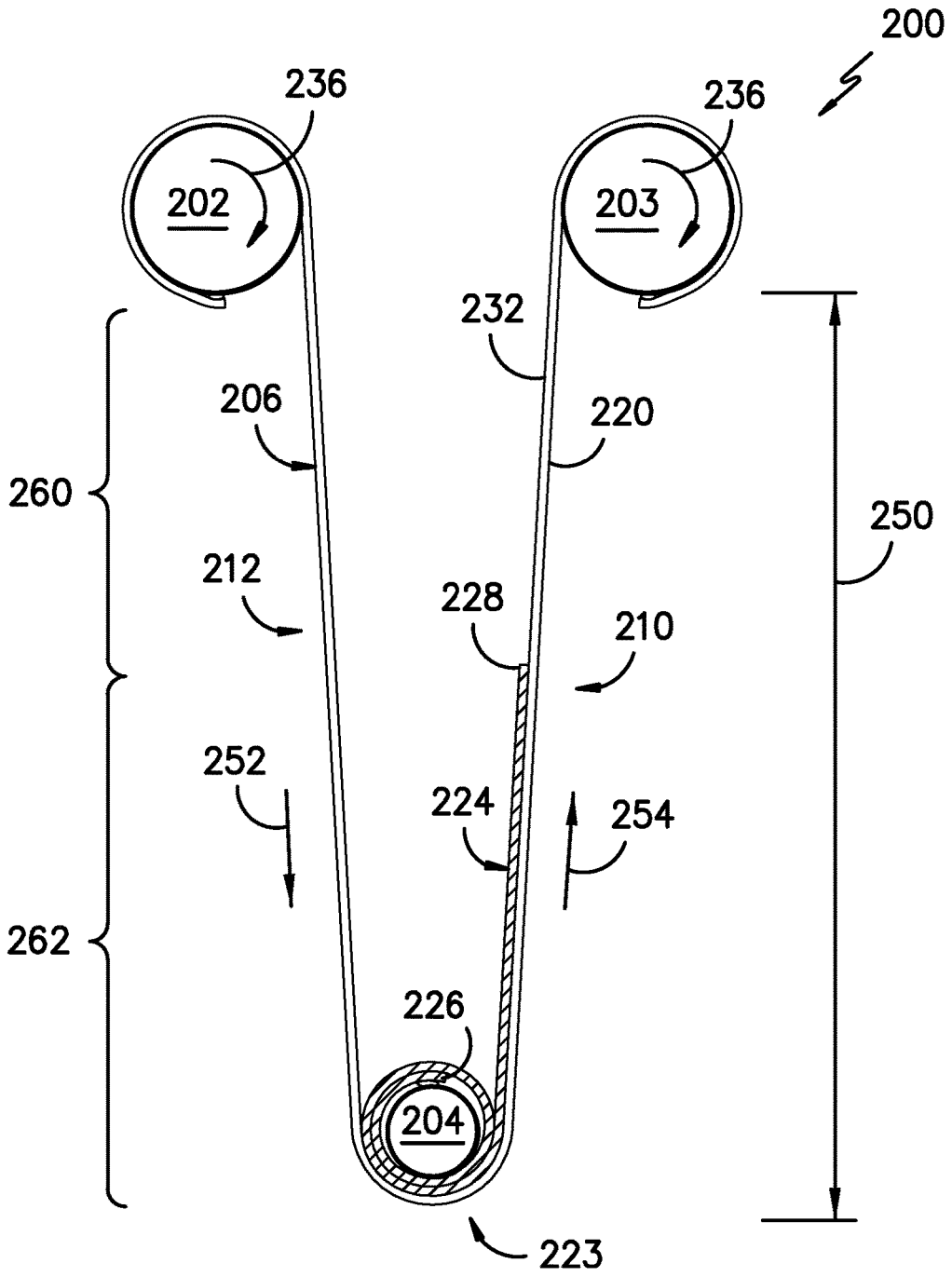
FIG. 15 illustrates yet another cross-sectional view of the roller shade assembly shown in FIG. 13, particularly illustrating the roller assembly after an inner shade web of the assembly has been partially unwound from one of the rollers.
Figure 16:
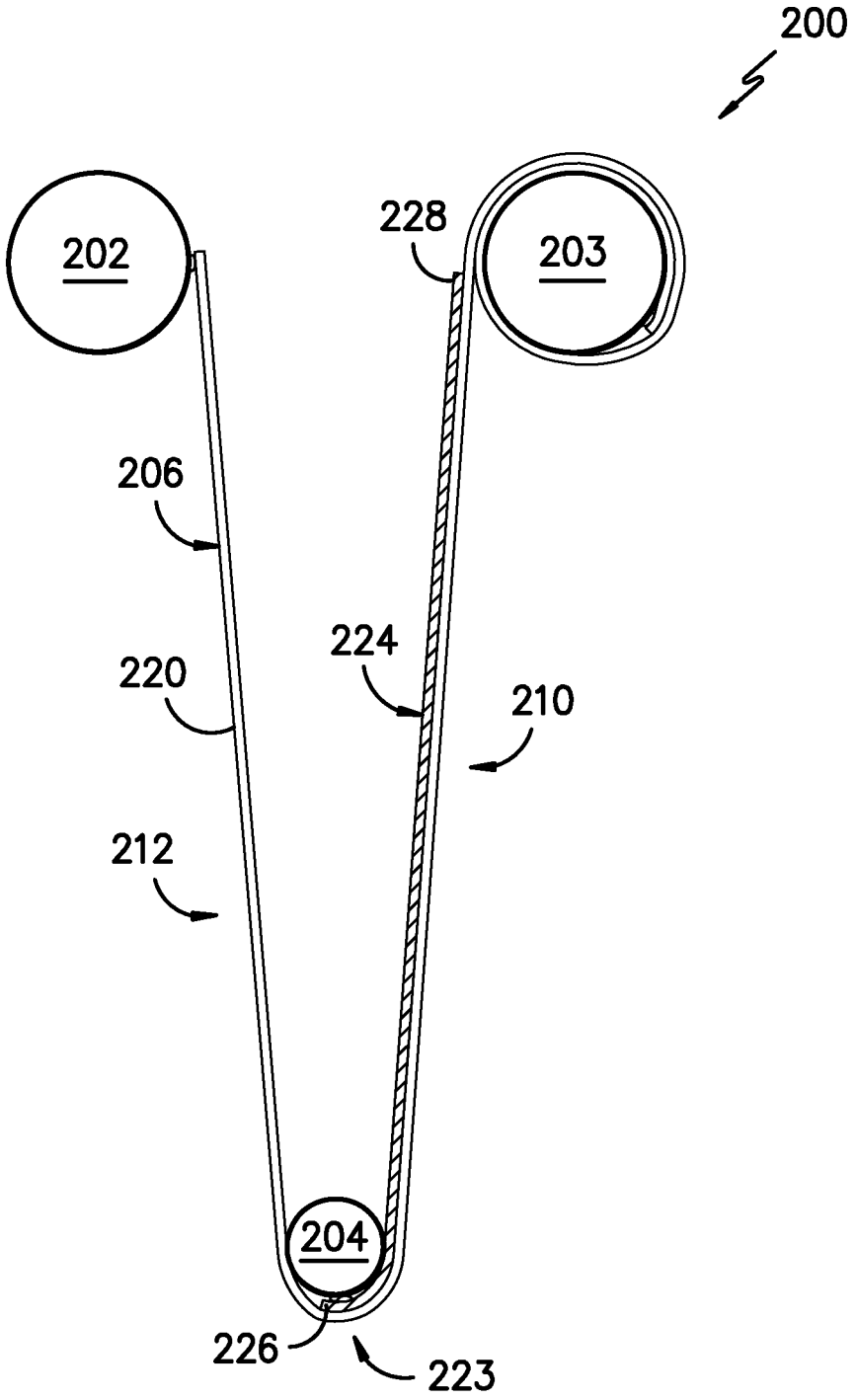
FIG. 16 illustrates a further cross-sectional view of the roller shade assembly shown in FIG. 13, particularly illustrating the roller assembly after the inner shade web has been fully unwound from the roller.

Referring now to FIGS. 13-16, various cross-sectional views of the roller shade assembly 200 shown in FIG. 12 are illustrated in accordance with aspects of the present subject matter. Specifically, FIGS. 13-16 illustrate a time-ordered progression of the roller shade assembly 200 as it moved from its raised position (FIG. 13) to its lowered position (FIG. 14) and as an inner shade web 224 of the roller shade assembly 200 is unwound from the idling roller 204 (FIGS. 15 and 16).

As shown in FIG. 13, when in the raised position, the outer shade 206 may be configured to be primarily wound around each of the first and second drive rollers 202, 203. As will be described below, in a particular embodiment of the present subject matter, the portion of the outer shade 206 that is wound around the first drive roller 202 when the roller shade assembly 200 is in the raised position may be equal to two times the portion of the outer shade 206 that is wound around the second drive 203. Additionally, as shown in FIG. 13, an unwound portion 222 of the roller shade may 220 extend between the drive rollers 202, 203 so as to support the idling roller 204. Specifically, as shown in the illustrated embodiment, the unwound portion 222 of the outer shade 206 may be configured to form a cradle or looped-end 223 between the drive rollers 202, 203 for supporting the idling roller 204.

Moreover, as indicated above, an inner shade web 224 may be wrapped around the idling roller 204. In general, the inner shade web 224 may be configured the same as or similar to the inner shade webs 124, 124A, 124B described above with reference to FIGS. 2-11. For example, the inner shade web 224 may extend between an inner end 226 and an outer end 228, with the inner end 226 being coupled to the idling roller 204 and the outer end 228 being coupled to the inner surface 232 of the outer shade 206 (e.g., at a location at or adjacent to the inner perimeter formed by the looped end 223 of the outer shade 206).

As shown in FIGS. 13 and 14, to move the roller shade assembly 200 from its raised position to its lowered position, the first and second drive rollers 202, 203 may be rotated in a given direction (e.g., a clockwise direction, as indicated by arrows 236 shown in FIGS. 13 and 14) such that the outer shade 206 is simultaneously unwound from both drive rollers 202, 203, thereby increasing the length of the unwound portion 222 of the outer shade 206. As a result, the looped-end 223 of the outer shade 206 (and, thus, the idling roller 204) may be lowered (e.g., in the direction of arrow 238 shown in FIG. 13) away from the drive rollers 202, 203 such that the roller assembly defines any suitable drop length (FIG. 14).

It should be appreciated that, by simultaneously unwinding the outer shade 206 from the drive rollers 202, 203 as the roller shade assembly 200 is moved from its raised position to its lowered position, the idling roller 204 may be supported within the looped-end 223 of the outer shade 206 without rotating. As a result, the inner shade web 224 may be maintained wrapped around the idling roller 204 as the roller shade assembly 200 is being lowered.

As particularly shown in FIG. 14, in one embodiment, the outer shade 206 may be configured to be completely unwound from the second roller 203 when the roller shade assembly 200 is moved to its lowered position. For example, the length of the outer shade 206 configured to be wound around the second roller 203 when the roller shade assembly 200 is in its raised position may be selected so as to generally correspond to the desired drop length 250 for the roller shade assembly 200. As will be described below, by completely unwinding the outer shade 206 from the second roller 203 when the roller shade assembly 200 is initially moved to its lowered portion, the outer shade 206 may then be allowed to re-wind around the second roller 203 in the opposite direction as the rollers 202, 203 continue to be rotated in the clockwise direction.

Referring now to FIGS. 15 and 16, once the outer shade 206 is completely unwound from the second roller 203, continued rotation of the drive rollers 202, 203 in the clockwise direction may result in the outer shade 206 being further unwound from the first drive roller 202 as it is being simultaneously re-wound around the second drive roller 203 in an opposite winding direction to the initial winding direction for the second roller 203. Specifically, as shown in FIG. 15, the portion of the outer shade 206 being unwound from the first drive roller 202 may travel downwardly from the first roller 202 (as indicated by arrow 252) towards the looped end 223 of the outer shade 206 whereas the portion of the outer shade 206 being re-wound around the second drive roller 203 may travel upwardly (as indicated by arrow 252) from the looped end 223 to the second roller 203. Such movement of the outer shade 206, in turn, results in corresponding rotation of the idling roller 204 as the inner shade web 224 is being unwound therefrom. For example, as shown in FIG. 15, due to the attachment of the outer end 228 of the inner shade web 224 to the inner surface 232 of the outer shade 206, the inner shade web 22A may be unwound from the idling roller 204 as the outer shade 206 is re-wound around the second drive roller 203. Thus, as shown in FIG. 16, by continuing to re-wind the outer shade 206 around the second drive roller 203, the inner shade web 224 may be pulled upwardly along the interior of the outer shade 206 until the outer end 228 of the inner shade web 224 is located at or adjacent to the second drive roller 203.

It should be appreciated that, by configuring the roller shade assembly 200 in the manner shown in FIGS. 12-16, the shade assembly 200 may be provided with multiple different shade configurations. For example, as shown in FIG. 14, when the inner shade web 224 is still wound around the idling roller 204, the roller shade assembly 200 may have a first shade configuration depending on the material(s) used to form the outer shade 206. Specifically, by forming the outer shade 206 from a shade webs) 220 made of a transparent material, the roller shade assembly 200 may be provided with a transparent shade configuration. Similarly, by forming all or a portion of the outer shade 206 from a sheer material, the roller shade assembly 200 may be provided with a transparent shade configuration. In such an embodiment, as indicated above, it may be desirable for the outer shade 206 to be formed partially from both transparent and sheer materials so as to prevent any moire effects from occurring when the roller shade assembly 200 is configured in the position shown in FIG. 14. For instance, referring to FIG. 14, the portion of the roller shade extending along the first face 210 of the shade assembly 200 may be formed using a shade web(s) made from a transparent material whereas the remainder of the roller shade 206 may be formed using a shade web(s) 220 made from a sheer material.

Additionally, as shown in FIG. 16, when the inner shade web 224 is fully unwound from the idling roller 204, the roller shade assembly 200 may have a second shade configuration depending on the material(s) used to form the inner shade web 224. For example, by forming the inner shade web 224 from a light-filtering material, the roller shade assembly 200 may have a light-filtering shade configuration. Similarly, by forming the inner shade web 226 from a black-out material, the roller shade assembly 200 may have a black-out shade configuration.

In other embodiments, the roller shade assembly 200 may include a combination of shade configurations. For example, as shown in FIG. 15, when the inner shade web 224 is only partially unwound from the idling roller 204, an upper portion 260 of the roller shade assembly 200 may have a first shade configuration and a lower portion 262 of the roller shade assembly 200 may have a second shade configuration.

It should be appreciated that, although the roller shade assembly 200 is illustrated in FIGS. 12-16 as only including a single inner shade web 224 wrapped around the idling roller 204, the shade assembly 200 may, in alternative embodiments, include two or more inner shade webs wrapped around the idling roller 204. For example, similar to the embodiment shown in FIGS. 6-8, two inner shade webs may be wrapped around the idling roller 204, with each inner shade web being formed from a different material (e.g., a light filtering material and a black-out material). In such an embodiment, when the radially outermost inner shade web is completely unwound from the idling roller 204, the radially innermost inner shade web may begin to be unwound from the idling roller 204 as the radially outermost web begins to be wound around the second drive roller 203 together with the outer shade 206.

Figure 17:
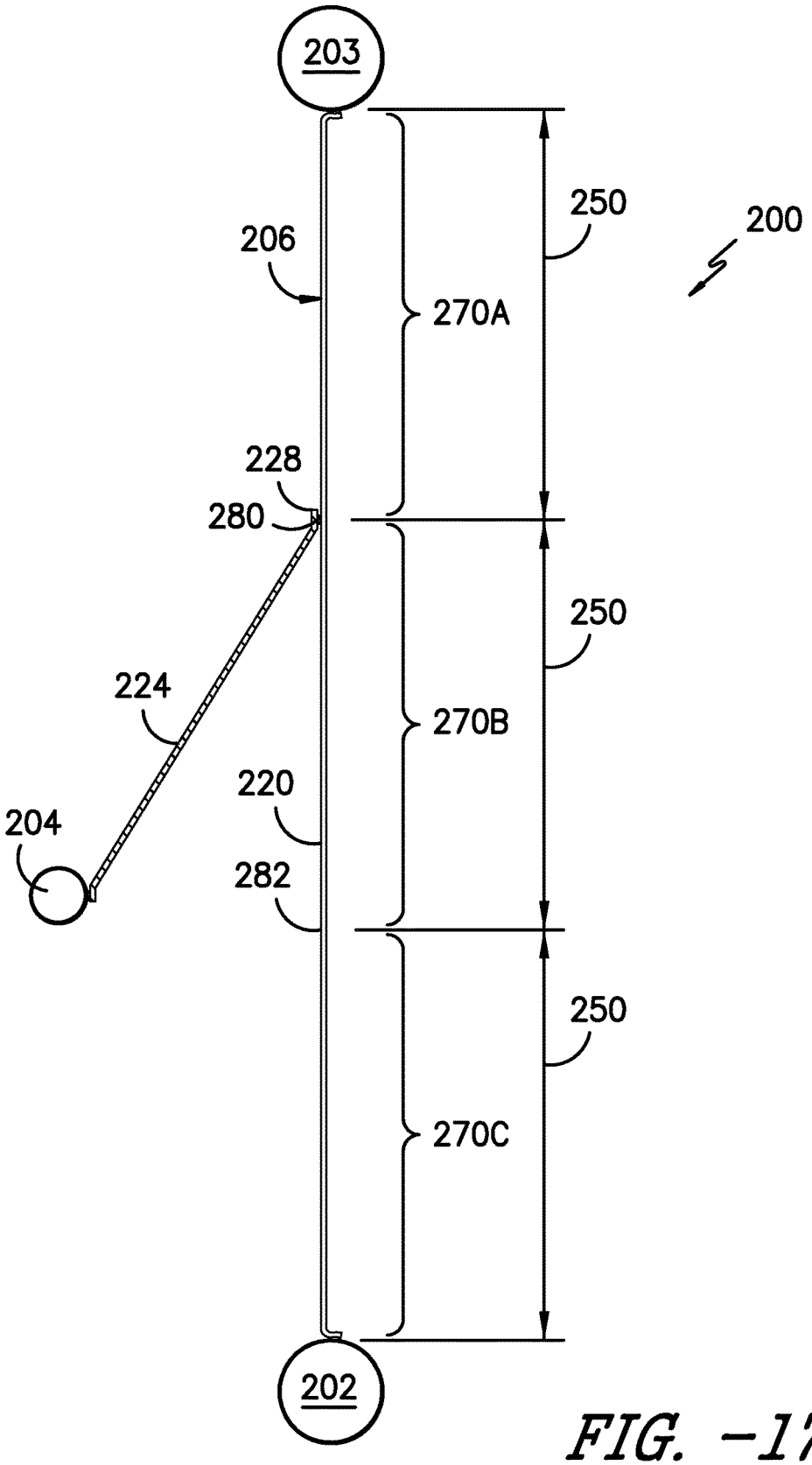
FIG. 17 illustrates a side view of the roller shade assembly shown in FIG. 13 with the shade webs of the assembly being fully unwound from their respective rollers to illustrate example lengths for the shade webs.

Referring now to FIG. 17, a side view of the outer and inner shade webs 220, 224 of the roller shade assembly 200 shown in FIGS. 12-16 completely unwound from their respective rollers 202, 203, 204 is illustrated in accordance with aspects of the present subject matter, particularly illustrating one embodiment of respective lengths for various portions of the outer shade 206 that may be utilized to allow the roller shade assembly 200 to function as described above. As shown in the illustrated embodiment, the outer shade 206 may be divided into three separate sections 270A, 270B, 270C, with each section generally defining a length equal to the desired drop length 250 for the shade assembly 200. Specifically, the outer shade 206 may include a first section 270A extending between the second drive roller 203 and a first location 280 corresponding to the attachment location of the outer end 228 of the inner shade web 224 to the outer shade 206. Additionally, the outer shade 206 may include second and third sections 270B, 270C extending between the first location 280 and the first drive roller 202, with the second section 270B extending between the first location 280 and a second location 282 spaced apart from the first location 280 by the desired drop length 250 and the third section 270C extending from the second location 282 to the first drive roller 202. As a result, the portion of the outer shade 206 extending between the first drive roller 202 and the attachment location of the inner shade web 225 (i.e., the second and third sections 270B, 270C) may generally define a length that is equal to twice the length of the portion of the roller shade 206 extending between the second drive roller 203 and the attachment location (e.g., the first section 270A).

By configuring the roller shade assembly 200 as shown in FIG. 17, the shade assembly 200 may function as described above with reference to FIGS. 12-16. For example, when the roller shade assembly 200 is in its raised position (as shown in FIG. 13), the first section 270A of the outer shade 206 may be substantially wrapped around the second drive roller 203 whereas the second and third sections 270B, 270C may be wrapped around the first drive roller 202. Additionally, when the roller shade assembly 200 is moved from its raised position to its lowered position (as shown in FIG. 14), the first section 270A of the outer shade 206 may be unwound from the second drive roller 203 while the second section 270B is simultaneously unwound from the first drive roller 202, with the third section 270C still remaining wound around the first drive roller 202. Thereafter, as the rollers 202, 203 are further rotated (e.g., as shown in FIGS. 15 and 16), the third section 270C of the outer shade 206 may be unwound from the first drive roller 202 as the first section 270A of the outer shade 206 is re-wound around the second drive roller 203.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A roller shade assembly for an architectural opening, the roller shade assembly comprising:

a first roller;

a second roller configured to be spaced apart from the first roller;

a looped shade extending around the first and second rollers, the looped shade comprising at least one outer shade web forming a continuous loop around the first and second rollers; and an inner shade web configured to be wound around and unwound from one of the first roller or the second roller such that the inner shade web is positioned within the continuous loop formed by the at least one outer shade web the inner shade web being coupled to the at least one outer shade web at a first location along an inner perimeter of the continuous loop, wherein rotation of at least one of the first roller or the second roller in an unwinding direction results in the inner shade web being unwound from the one of the first roller or the second roller along the inner perimeter of the continuous loop while the looped shade is moved in a looped path around the first and second rollers.

2. The roller shade assembly of claim 1, wherein the at least one outer shade web and the inner shade web are formed from different materials.

3. The roller shade assembly of claim 2, wherein the at least one outer shade web comprises a sheer material and the inner shade web comprises at least one of a light filtering material or a black-out material.

4. The roller shade assembly of claim 1, wherein the first roller corresponds to a drive roller and the second roller corresponds to an idling roller.

5. The roller shade assembly of claim 4, wherein the inner shade web is configured to be wound around and unwound from the second roller.

6. The roller shade assembly of claim 4, wherein the inner shade web is configured to be wound around and unwound from the first roller.

7. The roller shade assembly of claim 1, wherein the at least one outer shade web comprises a single shade web wrapped end-to-end around the first and second rollers to form the continuous loop.

8. The roller shade assembly of claim 1, wherein the at least one outer shade web comprises a first outer shade web and a second outer shade web coupled to one another so as to form the continuous loop.

9. The roller shade assembly of claim 8, wherein at least one of the first outer shade web or the second outer shade web is formed from a transparent material.

10. The roller shade assembly of claim 1, wherein:

the inner shade web comprises a first inner shade web and a second inner shade web;

the first inner shade web wrapped around the one of the first roller or the second roller radially inwardly from the second inner shade web; and the second inner shade web is coupled to the at least one outer shade web along the inner perimeter of the continuous loop.

11. The roller shade assembly of claim 1, wherein the inner shade web comprises a first inner shade web wrapped around the first roller, further comprising a second inner shade web wrapped around the second roller, the second inner shade web being coupled to the at least one outer shade web at a second location along the inner perimeter of the continuous loop.

12. The roller shade assembly of claim 1, wherein rotation of the at least one of the first roller or the second roller in a winding direction results in the inner shade web being wound around the one of the first roller or the second roller along the inner perimeter of the continuous loop while the looped shade is moved in a looped path around the first and second rollers.

13. The roller shade assembly of claim 1, wherein:

the inner shade web extends lengthwise between an outer end and an inner end;

the inner shade web is coupled to the at least one outer shade web at or adjacent to the outer end; and a portion of the inner shade web extending between the inner end of the inner shade web and the first location is not coupled to the at least one outer shade web to allow the portion of the inner shade web to be wound around and unwound from the one of the first roller or the second roller while the looped shade is moved in a looped path around the first and second rollers.

* * * * *